US006254013B1

(12) United States Patent
Clearman et al.

(10) Patent No.: US 6,254,013 B1
(45) Date of Patent: Jul. 3, 2001

(54) SPRAY HEAD FOR USE WITH LOW PRESSURE FLUID SOURCES

(75) Inventors: Joseph H. Clearman, Port Gamble, WA (US); Jack F. Clearman, Blakely, GA (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/352,519

(22) Filed: Jul. 13, 1999

(51) Int. Cl.[7] ..... B05B 3/02

(52) U.S. Cl. ..... 239/222.11; 239/222.17; 239/222.21; 239/383; 239/389

(58) Field of Search ..... 239/222.11, 428.5, 239/380, 383, 389, 222.17, 222.21

(56) References Cited

U.S. PATENT DOCUMENTS 5,950,927 * 9/1999 Elliot et al. ..... 239/233

FOREIGN PATENT DOCUMENTS

4221587 * 1/1994 (DE) ..... 239/381
4224664 * 1/1994 (DE) ..... 239/381
4319743 * 12/1994 (DE) ..... 239/381

* cited by examiner

*Primary Examiner*—David A. Scherbel
*Assistant Examiner*—Dinh Q. Nguyen
(74) *Attorney, Agent, or Firm*—Cook, Alex, McFarron, Manzo, Cummings & Mehler, Ltd.

(57) ABSTRACT

The present invention provides an apparatus with a wobble turbine that delivers fluid in a substantially uniform spray distribution. The movement of the wobble turbine is a wobbling motion, preferably combined with some rotational motion. The wobbling motion is generated by disposing a wobble inducing member or wobble turbine in the path of the fluid supply. The water flowing over the wobble turbine causes the turbine to wobble. The wobbling turbine has outlet channels disposed therein that distribute the water. The spray pattern produced by the apparatus changes more or less rapidly so that fluid droplets or streams are directed along arcuate paths rather than at a single point. This type of spray distribution pattern is gentler than many stationary patterns and the unique design of the wobble inducing member does not include complex mechanical parts or significant flow restrictions.

31 Claims, 8 Drawing Sheets

SPRAY HEAD FOR USE WITH LOW PRESSURE FLUID SOURCES

BACKGROUND OF THE INVENTION

1. Field of the Invention

The present invention relates to a spray head that provides desirable spray characteristics from a low pressure fluid source.

2. Background of the Related Art

Showerheads, faucets and other spray heads or nozzles are commercially available in numerous designs and configurations. While many showerheads and faucets are designed and sold for their decorative styling, there is a great number of different showerhead mechanisms which are intended to improve or change a characteristic of the water spray pattern. Any particular spray pattern may be described by the characteristics of spray width, spray distribution or trajectory, spray velocity, and the like. Furthermore, the spray pattern may be adapted or designed for various purposes, including a more pleasant feeling to the skin, better performance at rinsing, massaging of muscles and conservation of water, just to name a few.

The vast majority of spray heads may be categorized as being either stationary or oscillating and having either fixed or adjustable openings or jets. Stationary spray heads with fixed jets are the simplest of all spray heads, consisting essentially of a water chamber and one or more jets directed to produce a constant pattern. Stationary spray heads with adjustable jets are typically of a similar construction, except that some adjustment of the jet direction, jet opening size and/or the number of jets utilized is facilitated. For example, a showerhead typically used in new residential home construction provides a stationary spray housing having a plurality of spray jets disposed in a circular pattern, wherein the velocity of the spray is adjustable my manually rotating an adjustment ring relative to the spray housing.

These stationary spray heads cause water to flow through its apertures and traverse essentially the same path in a repetitive fashion, such as a showerhead jet directing water at a fixed position on a person's skin. The user of such a showerhead feels a stream of water continuously on the same area and, particularly at high pressures or flow rates, the user may sense that the water is drilling into the body, thus diminishing the positive effect derived from such a shower head. In order to reduce this undesirable feeling from showerheads, and to improve the water distribution from spray heads generally, various attempts have been made to provide oscillating spray heads.

Examples of oscillating showerheads are disclosed in U.S. Pat. No. 3,791,584 (Drew et al.), U.S. Pat. No. 3,880,357 (Baisch), U.S. Pat. No. 4,018,385 (Bruno), U.S. Pat. No. 4,916,457 (Brewer), and U.S. Pat. No. 5,577,664 (Heitzman). U.S. Pat. No. 4,916,457 (Brewer) discloses an oscillating showerhead that uses an impeller wheel mounted to a gear box assembly which produces an oscillating movement of the nozzle. Similarly, U.S. Pat. No. 5,577,664 (Heitzman) discloses a showerhead having a rotary valve member driven by a turbine wheel and gear reducer for cycling the flow rate through the housing between high and low flow rates. Both of these showerheads require extremely complex mechanical structures in order to accomplish the desired motion. Consequently, these mechanisms are prone to failure due to wear on various parts and mineral deposits throughout the structure.

U.S. Pat. No. 3,691,584 (Drew et al.) also discloses an oscillating showerhead, but utilizes a nozzle mounted on a stem that rotates and pivots under forces places on it by water entering through radially disposed slots into a chamber around stem. Although this showerhead is simpler than those of Brewer and Heitzman, it still includes a large number of pieces requiring precise dimensions and numerous connections between pieces. Furthermore, the showerhead relies upon small openings for water passageways and is subject to mineral buildup and plugging with particles.

U.S. Pat. No. 5,187,927 (Lee) discloses a showerhead with a turbine having a plurality of blades designed to produce vibration and pulsation. One blade is provided with an eccentric weight which causes vibration and an opposite blade is provided with a front flange which cause pulsation by momentarily blocking the water jets. Again, the construction of this showerhead is rather complex and its narrow passageways are subject to mineral buildup and plugging with particulates.

U.S. Pat. No. 5,704,247 (Golan et al.) discloses a shower head including a housing, a turbine and a fluid exit body, such that fluid flowing through the turbine causes rotation of the turbine. The rotating (spinning) turbine can be used to cause rotation of the fluid exit body and/or a side-to-side rocking motion in a pendulum like manner.

U.S. Pat. No. 4,073,438 (Meyer) discloses a sprinkler head having a housing with an inlet, a water distributing structure having a nozzle on one end and a cup shaped element at the opposite end which is operative in response to the tangential flow of water into the housing for effecting the orbital movement of the nozzle. There is also disclosed a disk that rotates in rolling contact with a surface within the housing for effecting the fractional rotation of the nozzle. The cup shaped element rotates about the longitudinal axis in response to the flow of water from the inlet.

The foregoing devices, however, are not well suited for use with low pressure water sources, such as the water supplies in some rural areas, homes having partially restricted pipes, or in lesser developed nations. Therefore, there is a need for an improved spray head or showerhead that delivers water in a desirable and uniform fashion even at low pressures or flow rates suitable for use in showerheads and sink faucets. It would be further desirable if the spray head provided a simple design and construction with minimal parts.

SUMMARY OF THE INVENTION

The present invention provides a fluid discharging apparatus comprising: a body having a fluid inlet and a track formed adjacent the fluid inlet; and a wobble turbine engaged with the body downstream of the fluid inlet and in an axially spaced relationship to the fluid inlet, the wobble turbine having a first surface extending into rolling contact with the circular track, a plurality of blades configured to cause the wobble turbine to rotate when struck by a stream emitted from the fluid inlet and a downwardly angled annular deflector. The track may be circular, oval, elliptical or some other arcuate shape, but preferably has dimensions greater than those of the fluid inlet. It is also preferred that the wobble turbine engage the body in a loose male-female relationship, such as a post and sleeve relationship. The first surface of the wobble turbine typically forms a conical or concave conical surface. The plurality of blades are preferably disposed downstream of the first surface and extend radially outward having distal ends coupled to the deflector. The spray width of the apparatus may be adjustable where the housing is provided with an upper portion engaged with a lower portion to allow adjustment of the distance therebetween, such as be advancement of a threaded engagement.

The invention also provides a fluid discharging apparatus comprising: a body having a fluid inlet, a track formed adjacent the fluid inlet, and a bearing in an axially spaced relationship with the fluid inlet downstream of the fluid inlet; and a wobble turbine having a first end disposed within the bearing, a second end in rolling contact with the track, and a plurality of outlet channels formed between the first and second ends configured to cause the wobble turbine to rotate when a stream of the fluid is passed therethrough. Most preferably, the first end of the wobble turbine is a post, the second end of the wobble turbine is conical, and the bearing is a sleeve. It is also preferred to have the outlet channels formed on the perimeter of the turbine, aligned to receive fluid from the inlet as the fluid passes over the second end, and configured to discharge fluid adjacent the first end.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are, therefore, not to be considered limiting of its scope, because the invention may admit to other equally effective embodiments.

DETAILED DESCRIPTION OF THE INVENTION

Figure 1:
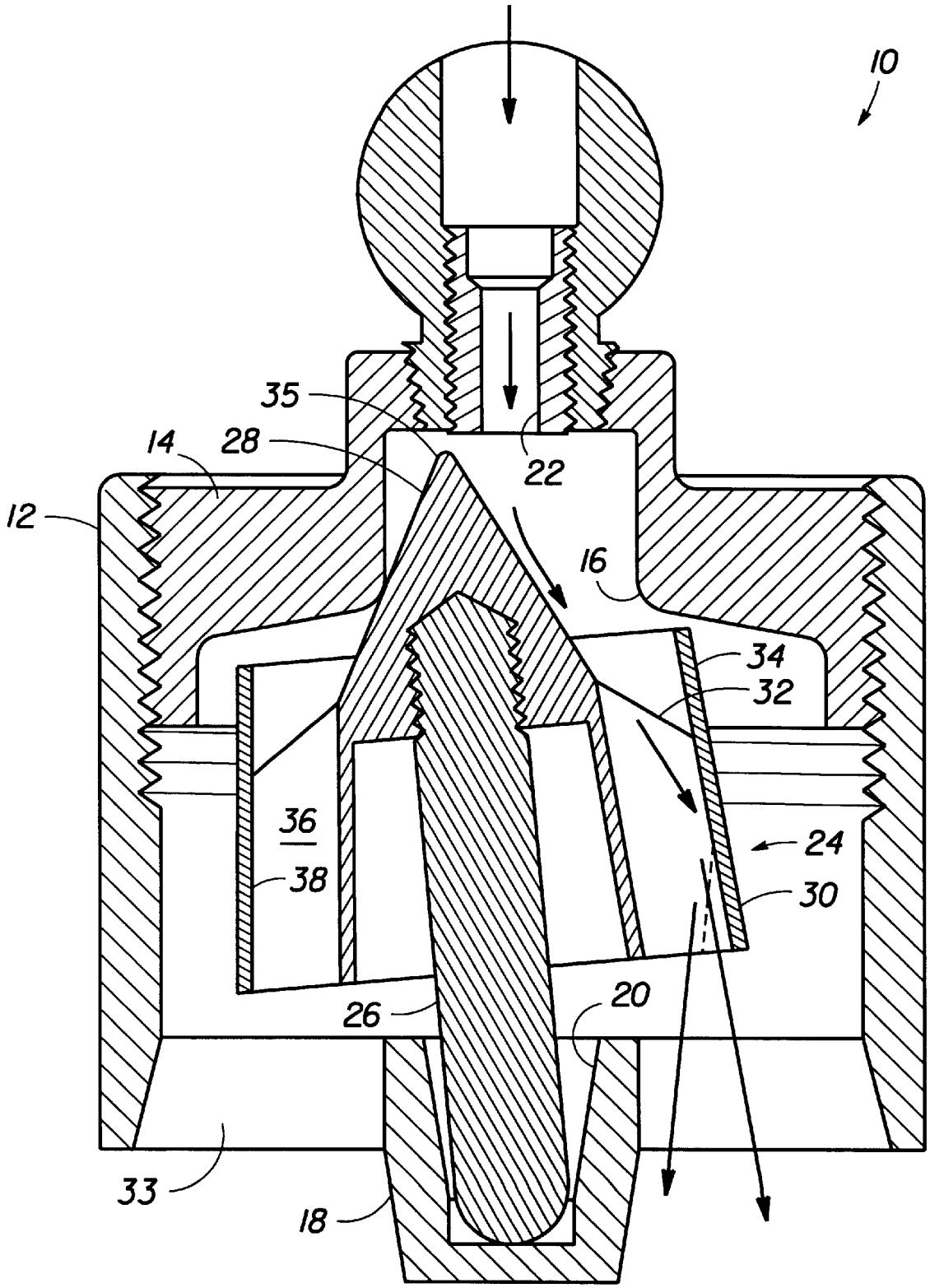
FIG. 1 is a cross-sectional side view of a first embodiment of a spray head assembly of the present invention.

The present invention provides a spray head assembly with a moving spray nozzle that delivers fluid in a desired spray distribution with minimum velocity or momentum loss and controlled droplet size. The movement of the spray nozzle is a wobbling motion, preferably combined with some rotational motion. The wobbling motion is generated by disposing a wobble inducing member or wobble turbine in the path of the fluid supply with or without a housing. The water flowing over the wobble turbine causes the wobble turbine to wobble. The wobbling turbine then effects the direction of the spray pattern exiting the spray nozzle.

The term "wobbling" may be defined as the motion of a circular member rolling on its edge or surface along another surface following a circular path. A common example of wobbling is what occurs when a coin is spun on its edge over a smooth surface. The coin begins spinning or rotating in a vertically upright position, but as the coin slows, the coin begins to wobble along a circular path having an ever increasing diameter until the coin comes to rest on its face. While a wobbling motion will often be accompanied by some degree of rotation, a wobbling member will have points on its surface which experience a sequence of up and down motions as well.

The spray pattern produced by the wobble turbine changes more or less rapidly so that fluid droplets or streams are directed along arcuate paths over time rather than continuously at a single point. This type of spray distribution pattern is gentler than many stationary patterns and the unique design of the wobble turbine does not include complex mechanical interconnections or significant flow restrictions. This wobbling, roto-nutational fluid distribution is described in co-pending U.S. patent application Ser. No. 09/115,362 which is incorporated by reference in its entirety herein.

One aspect of the invention provides an apparatus with a wobble inducing member that is integral with a plurality of outlet channels that direct the fluid. With this design, the fluid flow can be reduced while evenly distributing the fluid stream over a wide area without relying on small outlet channels or orifices. The wobble turbine may be supported by a housing having a bearing or sleeve that is mounted to a plurality of thin fins extending from an outer wall of the housing. The fins are positioned below the outlet channels of the turbine and provide minimal interference to the overall fluid flow. This type of housing is ideal for use with a reduced water flow to provide a satisfying stream of water that is particularly useful in a sink faucet. As used herein, the terms "housing", "body" and "frame" are used synonymously to broadly mean a securing member or supporting framework and is not intended to be limited to an encompassing wall or chamber.

The wobble inducing member or wobble turbine wobbles about a stream of water contacting the wobble turbine. More particularly, the wobble inducing member is positioned in loose contact with the housing of the apparatus, thus reducing the number of parts and increasing the ability of the apparatus to produce a desired spray width and pattern, such as for a residential shower or faucet. In addition, the water is deflected along the wobble turbine and travels substantially without restriction to the outlet channels which can be provided in any number and any configuration(s).

Preferably, the wobble inducing member is disposed in direct engagement or contact with the housing. More particularly, the housing has an end that is distal to the water inlet. It is preferred that this distal end of the housing and the wobble inducing member receive each other in a loose male-female relationship, particularly where the distal end and the wobble inducing member can easily slide or pivot into the appropriate relationship without restriction. One particularly preferred arrangement is a post forming a cylindrical, conical or frustoconical surface (male) received within a conical or frustoconical sleeve (female), where the bottom surface of the post is preferably rounded or otherwise formed to minimize friction and binding between the members. It should be recognized that the sleeve may be formed as an integral part of the housing and the post may be part of the wobble inducing member. It is preferred to design the post and sleeve with sufficient tolerances therebetween so that the wobble inducing member can wobble in relation to the spray housing without binding. Furthermore, it is most preferred to utilize a wobble inducing member having a conical upper surface with a first diameter, wherein the conical upper surface is formed around a post having a second, reduced diameter received in a conical or frusto-conical sleeve of the spray housing.

One advantage of the loose fitting relationship of the wobble inducing member or wobble turbine to the spray nozzle assembly is that there is very little friction to be overcome before the wobble turbine will begin wobbling. In this manner, the initiation and maintenance of a wobbling motion of the spray nozzle of the present invention is substantially independent of fluid flow rate or pressure and operates very effectively in shower heads and faucets even at flow rates much lower than the 2.5 gallons per minute maximum imposed by the laws of many states.

A second advantage of the loose fitting relationship is that the wobble turbine is easily cocked, shifted or tilted away from the centerline of the fluid supply inlet. In fact, even when no fluid is being passed through the spray head assembly, the wobble turbine may rest at a tilted angle relative to the centerline of the fluid supply inlet. In order to provide the most effective wobbling motion, it is desirable for the wobble turbine to be shifted sufficiently away from the centerline of the fluid supply so that a major portion of the fluid supply is being directed at one side of the wobble turbine face at any given point in time. The loose fitting relationship allows the spray head assembly of the present invention to achieve a sufficient shifting of the wobble turbine within a much shorter axial distance (vertical distance as shown in FIG. 1) and with fewer parts.

Yet another aspect of the invention provides a wobble limiting member. The spray width of a spray nozzle of the present invention is determined by the both the design of the outlet channels in the wobble turbine and the angle of deflection imparted on the wobble turbine. For example, if the outlet channels of the spray nozzle provide a 6° spray width during use in a stationary mode and the wobble limiting member produces an angular deflection of the turbine to 5° off center, then the effective spray width during use in a wobbling mode in accordance with the present invention would be about 16° (5° additional width in all directions). Therefore, the wobble limiting member plays an important role in determining the effective spray width of the spray nozzle as well as the extent of the arcuate path that each fluid stream traverses during a single wobble.

The preferred wobble limiting member is a tracking ring formed in the upper end of the housing. The upper surface or apex of the wobble turbine is in rolling contact with the tracking ring when driven by water flow from the inlet in the top of the housing. The housing can be adjusted in length (vertically as shown in FIG. 1), such as by advancing a threaded relationship between the upper and lower portions of the housing, thus changing the angle of deflection for the wobble turbine accordingly. Bringing the tracking ring closer to the wobble turbine will decrease the width of the spray pattern, while moving the tracking ring away from the wobble turbine will increase the width of the resulting spray pattern.

It should be recognized that the spray head assemblies of the present invention, and the individual components thereof, may be made from any known materials, preferably those materials that are resistant to chemical and thermal attack by the fluid passing therethrough. Where the fluid is water, the preferred materials include plastics, such as polytetrafluoroethylene, and metals or metal alloys, such as stainless steel. Other and further materials suitable for use in the present invention should be apparent to one of skill in the art and are considered to be within the scope of the present invention.

FIG. 1 is a cross-sectional view of one embodiment of an apparatus 10 of the present invention. The apparatus 10 has a housing 12 with an upper end 14 defining an inwardly extending track 16 and a lower end defining a sleeve 18 having a generally frusto-conical inside surface 20 that opens toward the upper end 14 of the housing 12. The apparatus includes a water inlet 22 in the upper end of the housing, preferably A aligned with the central axis of the housing 12. A wobble turbine 24 has a lower end or post 26 disposed or extending inside the sleeve 18. The inside surface 20 of the sleeve 18 has a slightly larger inner diameter over most of its length than the outer diameter of the lower end or post 26 of the wobble turbine 24. The track 16 is generally annular and acts as a wobble limiting member to define the degree of wobble experienced by the wobble turbine and generates rotation. It should be recognized that the wobble turbine 24 and track 16 are in rolling contact and their materials should provide at least some friction as required to produce a consistent wobbling or nutating action, yet not so much friction as to dissipate the momentum of the water or cause binding of the turbine. The area of contact being the turbine and the track is a controllable factor in determining the amount of friction therebetween.

The wobble turbine 24 has an upper surface 28 that is generally conical in shape, a middle portion 30 that forms a plurality of blades 32 extending radially therefrom, and the lower portion or post 26. The middle portion 30 of the wobble turbine 24 preferably has a wall 34 connecting each blade 32 such that outlet channels 36 are formed between adjacent blades 32. The lower end of the wobble turbine is a generally cylindrical post 26 having a rounded bottom surface. The conical upper surface 28 is preferably pointed at the apex 35. The distal end of the housing 12 is substantially open and has thin vanes 33 that secure the sleeve 18 to the housing. The outlet channels 36 may have varying dimensions, such as the angle(s) or contour of the inside surface 38 of the wall 34, in order to direct the water in a uniform flow pattern.

When assembled, the post 26 of the wobble turbine 24 rests inside the sleeve 18. The wobble turbine and the sleeve may be made from any suitable material, but preferably are made from one or more injection moldable or extrudable polymer materials, most preferably an acetal resin such as DELRIN (a trademark of Du Pont de Nemours, E.I. 7 Co. of Wilmington, Del.). There is preferably very little friction between the post 26 and the sleeve 20.

In operation, the water flow enters through the water inlet 22 and strikes the top surface 28 of the wobble turbine 24. The force of the water stream against the conical surface 28 induce the wobble motion of the wobble turbine 24 when contacted with a stream of water. The wobble turbine 24 wobbles and is in rolling contact with the inside surface of the track 16 in a counter-clockwise direction (as seen from the water inlet given the turbine blade pitch shown in FIG. 2) about the centerline of the fluid stream coming from the water inlet 22. The water flows down the top of the wobble turbine and is directed into the outlet channels 36 by the deflector wall 34. The wall 34 preferably extends upwardly above the blades 32 and generally follows an angle that converges toward the centerline of the apparatus.

The relative angles of the wobble turbine surface 28 and the wall surface 38 are preferably designed so that the fluid maintains as much velocity or momentum as possible. While the wobble turbine may conceivable distribute fluid at a first angle from that is anything less than 90 degrees from axial, the turbine should distribute fluid at an angle less than 45 degrees from axial, preferably less than 30 degrees from axial, and most preferably between about 20 and about 25 degrees from axial. The deflector wall 34 should receive or intercept the distributed fluid from the turbine with a surface 38 having an angle from axial similar to or less than the first angle at which the fluid is distributed off the turbine. While the surfaces 28 and 38 are shown as being straight, these surfaces may be curved or contoured, such as with the turbine surface 28 being concave out and the deflector surface 38 being concave in. Furthermore, the surface 28 may be ribbed or vained to better facilitate fluid entry into the channels 34.

While the deflector may redirect the fluid at many angles, even angles toward the axial centerline instead of angles away from axial, the deflector should have a smooth surface 38 at a slope sufficient to redirect fluid into a tighter fluid discharging pattern than a given turbine would have otherwise provided. Preferably, the deflector will redirect the fluid at an angle within about ±20 degrees of a line parallel to the axial centerline, and even more preferably the deflector will redirect fluid at two or more angles, such as having twelve channels 36 with four of them angled at 0 degrees and the other eight angles at 10 degrees.

The wobble angle, and thus the spray width, may be adjusted by changing the position of the upper portion of the housing. The upper portion is threadably engaged with a lower portion of the housing such that the lower portion can be adjusted up or down horizontally with respect to the centerline of the wobble turbine. Thus, if the user wants a wider distribution pattern, then the lower portion of the housing can be adjusted downward to provide greater room (a greater angle relative to the axial centerline) for the turbine to rotate. Likewise, for a narrower distribution pattern, the lower portion can be adjusted upward to restrict the degree of wobble.

Figure 2:
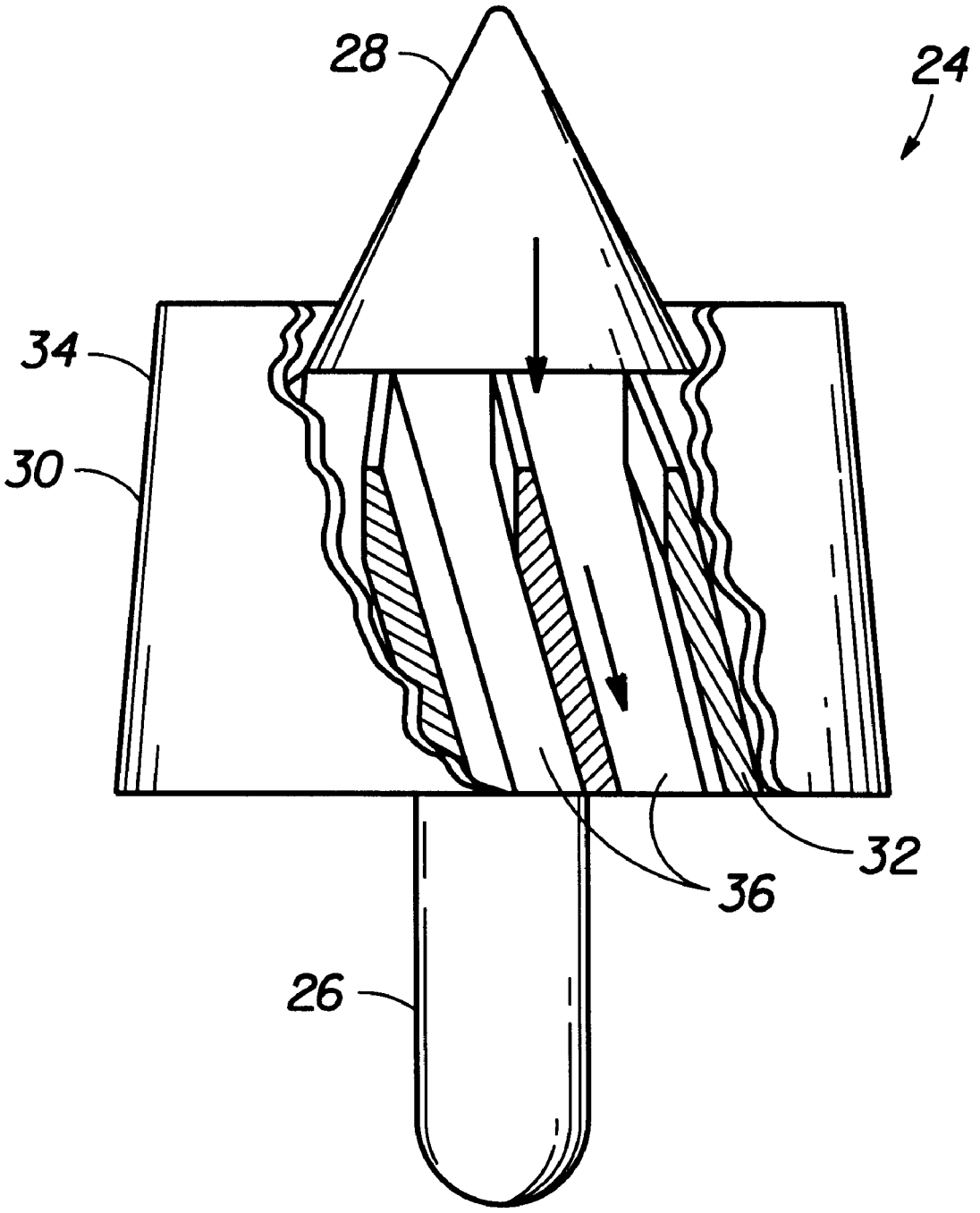
FIG. 2 is a partial sectional view of the wobble turbine shown in FIG. 1.

FIG. 2 is a partial cross-sectional view of the turbine 24 shown in FIG. 1. The blades 32 are angled so that the water flow, indicated by the arrows, is directed down and out of the turbine to induce the turbine to wobble, preferably with as little angle of deflection as necessary to prevent loss of fluid velocity or momentum. Minimizing the angular deflection of the fluid flow path from the point of contact with the top of the turbine to the distal end of the outlet channels makes the most efficient use of low pressure water flows, such as those having pressures between about 2 and 3 pounds per square inch (psi). If the water pressure is greater than desired, the water inlet may be fitted with a flow control element to adjust the amount of water flowing into the apparatus. It should be recognized that one skilled in the art can modify the angles on the blades 32 to suit a particular application.

Figure 3:
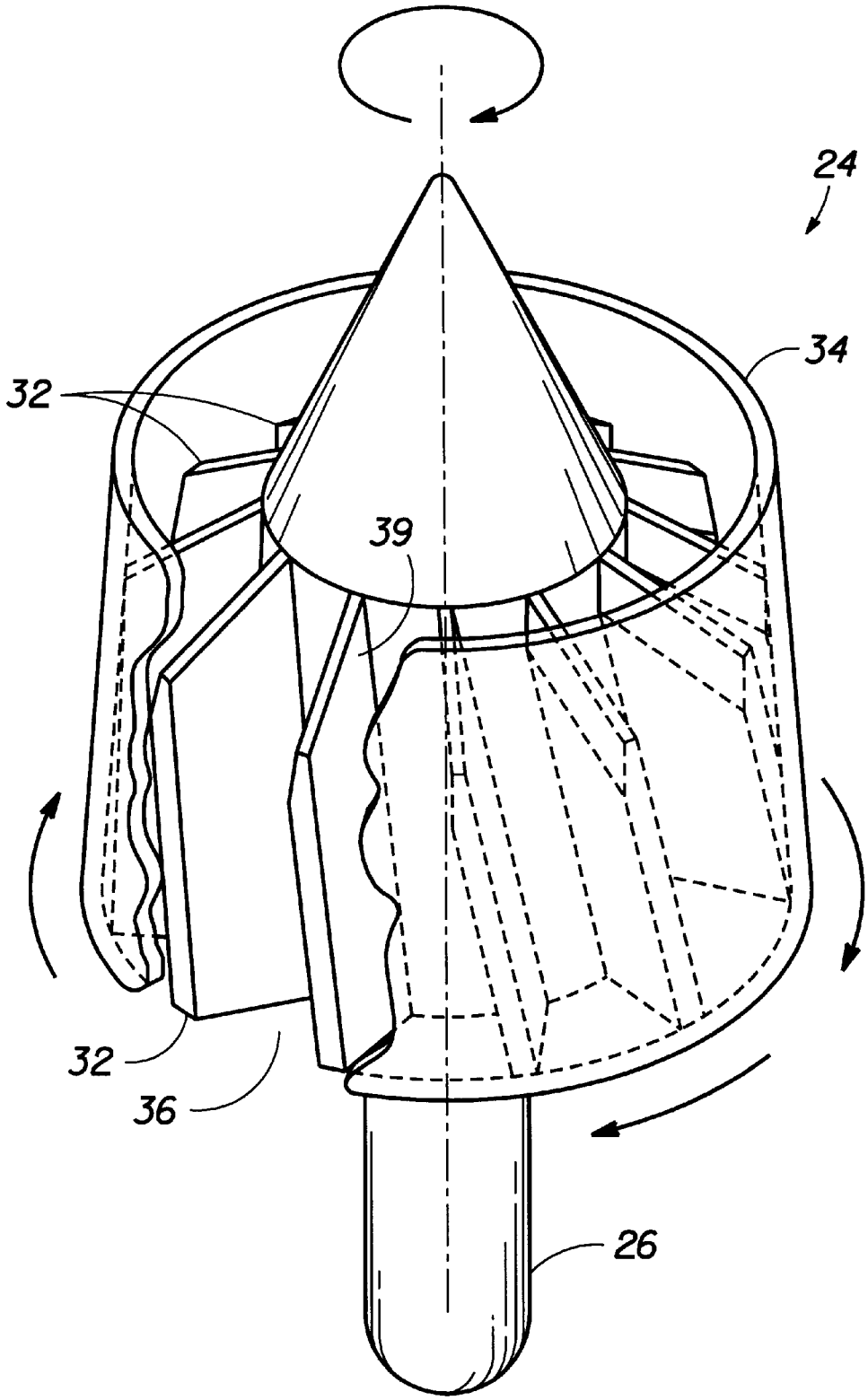
FIG. 3 is a perspective view of the wobble turbine shown in FIG. 1.

FIG. 3 is a perspective view of the turbine 24 shown in FIG. 1 with hidden portions shown in dashed lines. Each of the blades 32 extend radially about the post 26. Preferably, each of the blades 32 have an angled side surface 40 that imparts angular motion on the turbine 24 when contacted with a water stream. The angled side surface 40 preferably forms an angle with the vertical side surface of between 5 and 15 degrees, most preferably about 7 degrees. The pitch of the angle effects how fast the turbine will rotate in response to the water stream contacting the blades. The water hits the top of the blade and travels down the angled side surface 40, thus pushing the turbine 24 in a clockwise direction. The blades work in cooperation with the wall 34 which has an inner surface that is downwardly opening to direct water at one or more desirable angles.

When water enters the housing 12 and strikes the top of the turbine 24, the turbine will tilt to one side and wobble in a counter-clockwise direction within the limits set by the tracking ring 16 and perhaps also the sleeve 18. The water is deflected off of the turbine surface 28 and through the outlet channels. The housing 12 supports the sleeve 18, preferably using about 3 or 4 thin, radially extending fins 33 extending from the inside wall of the housing 12 toward the sleeve 18.

In one preferred embodiment, the upper portion of the wobble turbine is a smooth conical surface 28 with a pitch of approximately 22 degrees relative to the centerline of the wobble turbine. The inside surface 38 of the deflector wall forms an angle of approximately 17 degrees with the centerline of the wobble turbine so that the fluid travels over and through the wobble turbine with a minimal change in direction and a minimal loss of velocity or momentum. This design works especially well in areas where the water pressure is low in order to minimize any further reduction in the flow rate or velocity.

Figure 4:
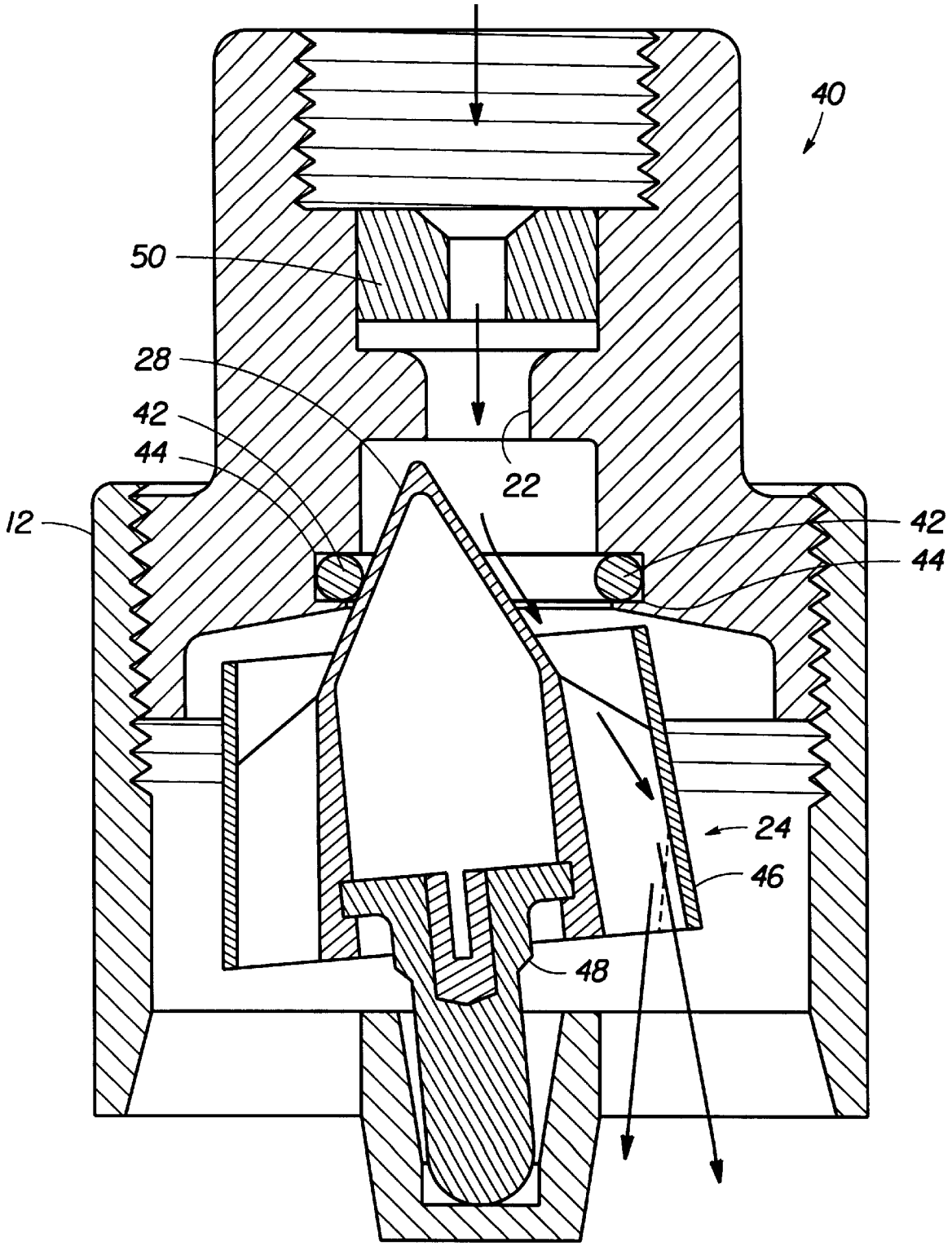
FIG. 4 is a cross-sectional view of a second embodiment of a spray head.

FIG. 4 is a cross-sectional view of a second embodiment of a spray head. The spray head 40 has a track surface provided by an annular ring 42 secured in an annular groove 44 formed in the surface 16 of housing 12. The annular ring 42 is preferably made from a material having a smooth, slide-resistant surface for contacting surface 28 of the turbine 24, such as a rubber or soft polymer material. The slide-resistant annular ring 42 help to assure that the turbine rotates as it wobbles instead of sliding around the track without rotation.

FIG. 4 also illustrates a unique two-piece construction for the wobble turbine 24. Rather than having a one-piece molded wobble turbine/post, the turbine is constructed of a blade assembly 46 with a post assembly 48 snapped into or otherwise secured to a lower portion of the blade assembly 46. Referring back to FIG. 1, a blade assembly may also be attached to a post assembly in an upper portion of the blade assembly. In the case of a two-piece wobble turbine, the pieces may be secured together by any conventional means, including but not limited to glue, threads, friction, ribbing, welding, and the like.

Finally, FIG. 4 includes a flow control washer 50 positioned in the inlet 22 to the spray head 40 for controlling the fluid flow rate through the spray head. A typical flow control washer works on the principle of compressing rubber. Such washers are available under the tradename Vernay from Vernay Labs of Yellow Springs, Ohio.

Figure 5A:
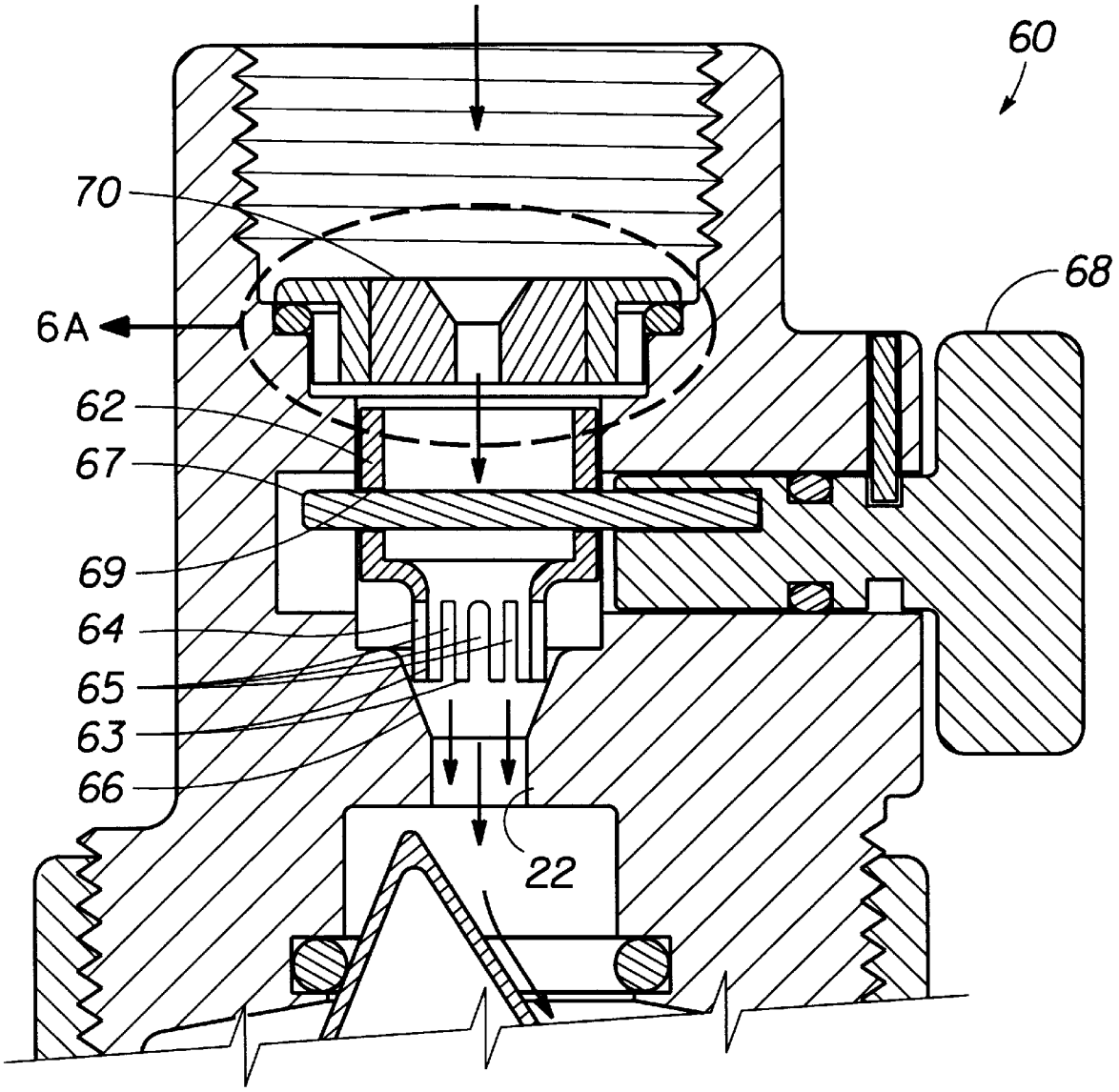
FIGS. 5A and 5B are cross-sectional views of a spray head having a fluid inlet with a variable cross-sectional area in the fully open and restricted positions, respectively.
Figure 5B:
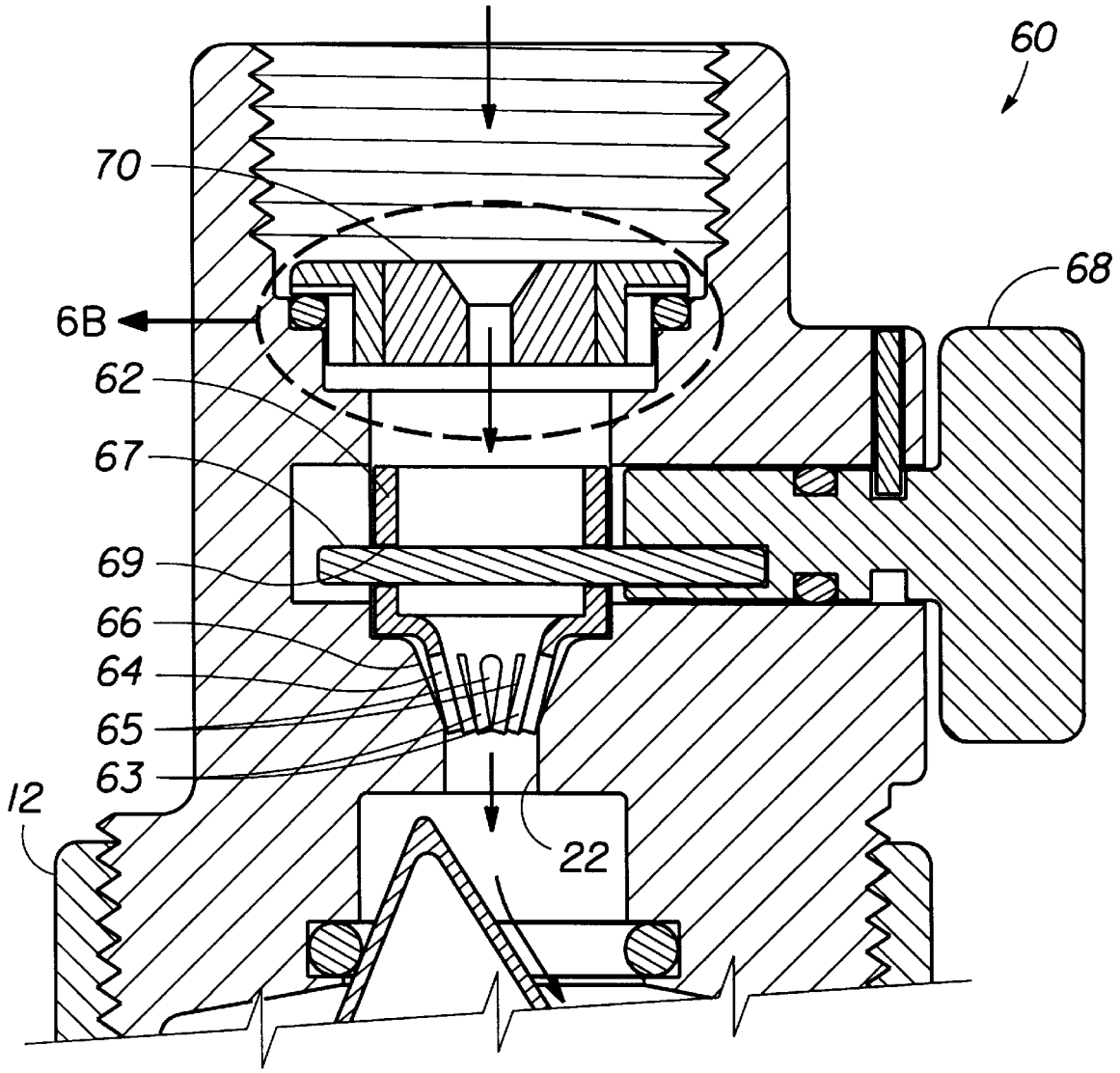

FIGS. 5A and 5B are cross-sectional views of a spray head 60 having a fluid inlet 22 with an optional variable cross-sectional area orifice in the fully open and restricted positions, respectively. Control of the cross-sectional area of this orifice allows the user to vary water velocity for impact and droplet size control.

FIG. 5A shows the inlet 22 with a conical or narrowing throat region 66 in communication with a valve or insertion member 62 having a first end 64 that is extendable into the inlet 22 to reduce the effective cross-sectional area of the inlet 22. The insertion member 62 is preferably actuated by a knob or handle 68 between the fully open position (meaning that the inlet is unrestricted by the member 62) as shown in FIG. 5A, the restricted position (meaning that the inlet is as fully restricted as the member 62 is designed to achieve) as shown in FIG. 5B, or any position in between. The knob or handle 68 is shown coupled to an off-center pin 67 that communicates with a guide hole 69 through the insertion member 62 so that turning the knob 68 in a first direction lowers the pin 67 (toward the inlet 22) and urges the first end 64 of the member 62 into the inlet 22 and turning the knob 68 in a second direction raises the pin 67 (away from the inlet 22) and withdraws the first end 64 of the member 62 out of the inlet 22. The insertion member 62 is preferably made of a pliable polymer or rubber material and the first end 64 preferably includes slots 65 to form a plurality of fingers 63 that can bend on contact with the narrowing region 66 to extend easily into the inlet 22. Alternatively, the member or valve 62 is another type of valve know in the art, particularly those valves that can provide a smooth fluid flow through the inlet 22.

FIG. 5B is the same as FIG. 5A, except that the insertion member 62 has been actuated (valve partially closed) to restrict the effective cross-sectional area of the inlet 22. At fluid pressures greater than 15 psi, restricting the inlet 22 causes the differential pressure across a flow control device 70 to decrease and the fluid velocity through the inlet 22 to increase, resulting in a higher velocity fluid exiting the apparatus. The lower differential pressure allows the flow control device 70 to rise up onto the ribs 76 to open the passageways therethrough. When the insertion member 62 is retracted (valve opened), the fluid velocity drops, and the pressure on the flow control device increases to close the passageways. In this manner, the flow rate can be maintained constant while allowing a variable impact control, despite the pressure of the fluid source.

Figure 6A:
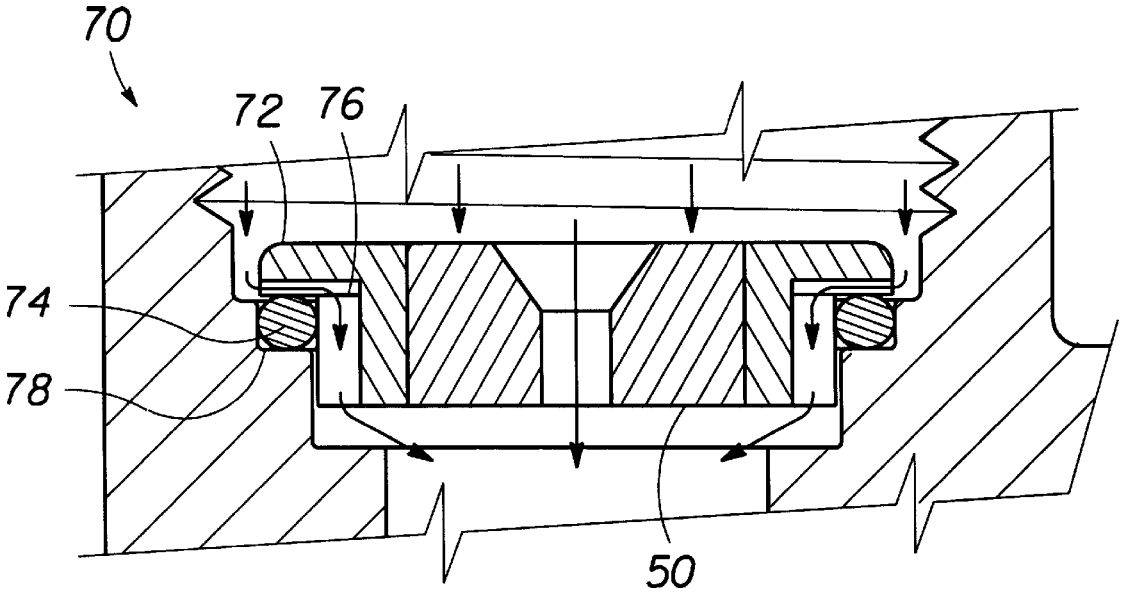
FIGS. 6A and 6B are cross-sectional views of a fluid flow control device in the open and closed positions, respectively.
Figure 6B:
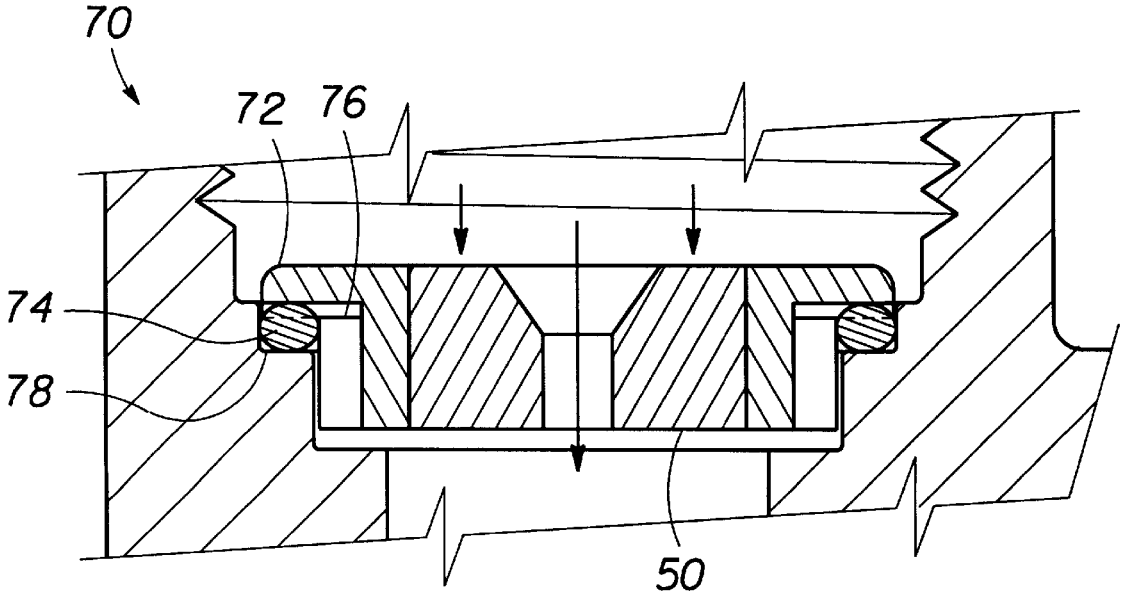

FIGS. 6A and 6B are cross-sectional views of the fluid flow control device 70 (See also FIG. 5A) in the open and closed positions, respectively. Flow controls based on the principle of compressing rubber are limited in the range of pressures that they operate. A typical flow control washer (as shown in FIG. 4) for providing 2.5 gallons per minute (GPM) of water operates nicely at water supply pressures above about 15 psi, but the flow rate drops rapidly as the pressure drops below 15 psi. Therefore, the present invention provides a bypass to increase the total flow rate through the fluid inlet 22 at fluid supply pressures below about 15 psi for residential applications, but below any desired minimum pressure setpoint as desired for a given application.

The fluid flow control device 70 is a floating or unsecured member formed around the perimeter of the flow control washer 50 and having a rim 72 with a plurality of shallow ribs 76 molded into the bottom side of the rim. The ribs 76 are preferably radially extending ribs that rest on an "O" ring 74, which is secured to a ledge or groove 78, and at low fluid supply pressures provide a fluid passageway between the ribs 76 so that fluid bypasses the flow control washer 50 and supplements the fluid flow through the control washer 50. As the fluid supply pressure increases, the floating control device 70 is forced downward, sinking the ribs 76 into the pliable polymer or rubber o-ring 74. At about 15 psi (or some other desired design pressure), the ribs 76 are completely embedded into the o-ring, thereby shutting off the bypass flow entirely. As the fluid supply pressure (actually the differential pressure) increases, the only path for the fluid is through the control washer. This or equivalent systems are beneficial to assure optimum performance over an extended range of pressures beyond that of a typical flow control washer, particularly the low pressures at which the present apparatus is particularly well suited. Alternatively, it should be recognized that the o-ring could also be secured to the bottom side of the rim to communicate with ribs formed on the ledge 78.

Figure 7:
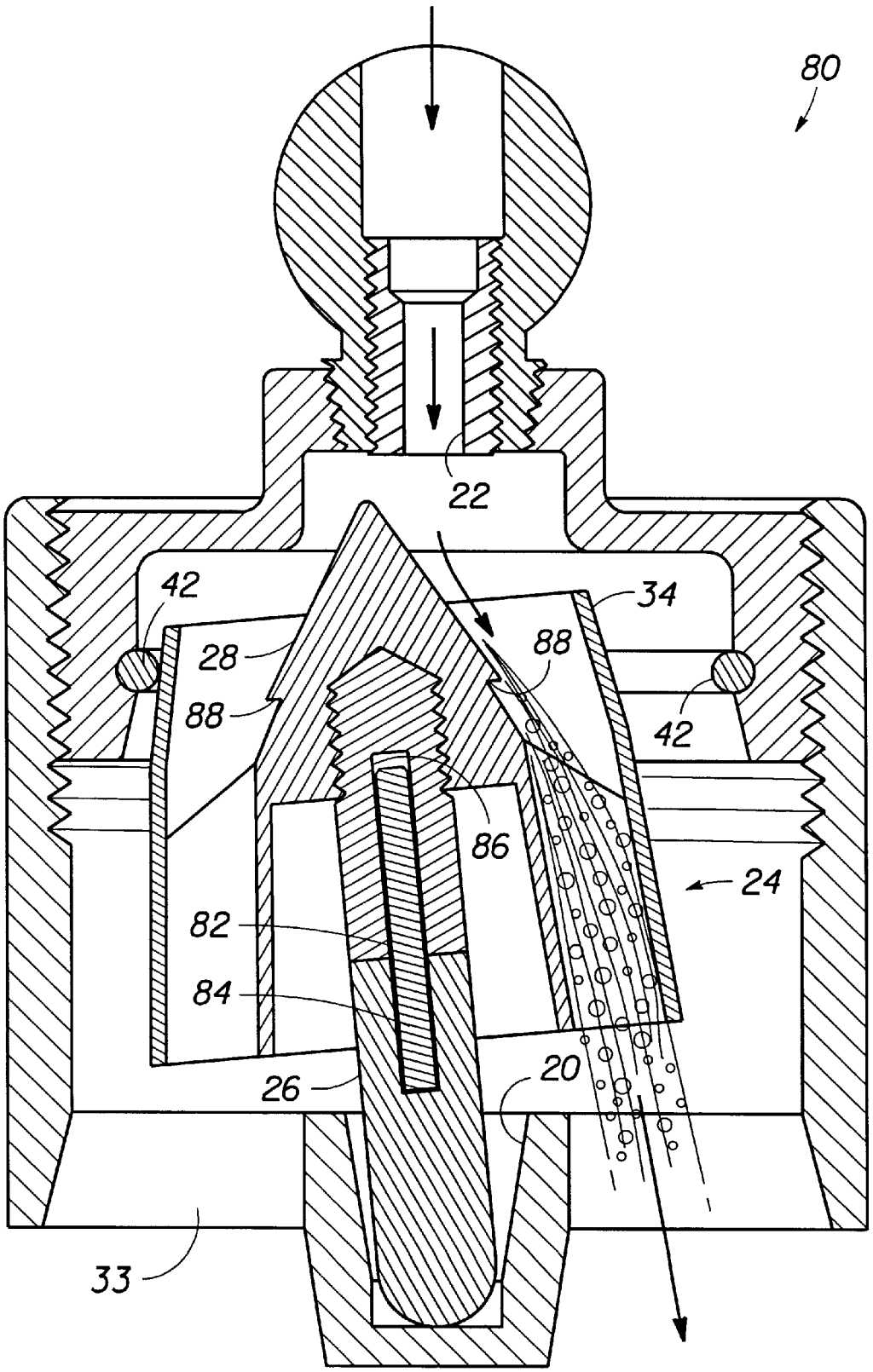
FIG. 7 is a cross-sectional view of a spray head having a bearing that coupled the turbine to the post.

FIG. 7 is a cross-sectional view of a spray head 80 having a bearing 82 that couples the upper portion of the turbine 24 to the post 26. The bearing 82 may be formed in any known fashion, but is preferably formed of a simple pin 84 extending from the post 26 that is received in a cylindrical sleeve 86 to allow the turbine to turn around the pin 84. In this arrangement, the upper portion of the turbine 24 having the sleeve 86 may rotate at one speed while the post 26 rotates at another speed or not at all, thus limiting or preventing any binding of the turbine. Furthermore, in order for the outer surface of the deflector 34, or alternatively a dedicated rolling portion of the turbine, to begin rolling along the track 42, the force of the water stream acting upon the turbine only has to overcome the friction in the bearing rather than the friction that may existing between the post 26 and sleeve 20.

The apparatus of the present invention has been found to produce a desirable shower by generating large droplets of fluid. The large size of these droplets is attributed primarly to two factors. First, the fluid is passed down only one side of the turbine at a time so that there is a large amount of fluid available to make the drops. Second, the flow washer allows the use of large outlet channels that provide substantially no flow restriction.

Furthermore, it has been observed that the turbines of the present invention can be made to aerate the water to a greater or lesser extent. A slight amount of aeration can occur since water is passing through only a portion of the channels 32, such as those on one side of the turbine, at any one time. If the turbine is wobbling at a very fast rate, it may be useful to consider that the water is passing through the channels in packets, i.e. plug flow, with air filling the space between packets. As the water suddenly passes through a channel, it pushes or drives the air along with it.

Referring back to FIG. 7, the amount of aeration can be increased by providing a channel for supplying air to the water stream as it passes over the turbine or through the channels. One particular design or method for increasing aeration is to provide an annular notch or groove 88 extending either partially or completely around the turbine surface 28. As the water passes over the notch, the air within the notch is drawn along with or into the water. In fact, if the notch is made to encircle the turbine, air may even be drawn into the notch by the action of the water. Nevertheless, a discrete notch, or portions of an annular notch, will fill with air when it is turned away from the water stream. As the notch turns towards the water stream, the air therein may be drawn into the water to provide aeration. One or more notches or grooves according to the invention may be used in combination or positioned, not only on the upper portion of the turbine, but on the lower portion of the turbine, the blades, the deflector or a combination thereof.

While the foregoing is directed to the preferred embodiment of the present invention, other and further embodiments of the invention may be devised without departing from the basic scope thereof, and the scope thereof is determined by the claims which follow.

What is claimed is:

1. A fluid discharging apparatus comprising:

a body having a fluid inlet and a fluid outlet, a track formed adjacent the fluid inlet;

a wobble turbine disposed downstream of and facing the fluid inlet for direct contact with fluid flowing therethrough, the wobble turbine having a first surface extending into rolling contact with the track, a plurality of blades configured to cause the wobble turbine to rotate when struck by a stream emitted from the fluid inlet and a downwardly angled annular deflector.

2. The apparatus of claim 1, wherein the track has a diameter greater than the fluid inlet.

3. The apparatus of claim 1, wherein the wobble turbine is engaged with the body downstream of the fluid inlet in a loose male-female relationship.

4. The apparatus of claim 3, wherein the loose male-female relationship is a post and sleeve relationship.

5. The apparatus of claim 4, wherein the track has an inside diameter that is smaller than the outer diameter of the blades.

6. The apparatus of claim 1, wherein the first surface of the wobble turbine is conical.

7. The apparatus of claim 6, wherein the conical first surface of the wobble turbine forms an angle of between about 20 and about 30 degrees with the centerline of the wobble turbine.

8. The apparatus of claim 1, wherein the plurality of blades are disposed downstream of the first surface.

9. The apparatus of claim 1, wherein the plurality of blades extend radially outward having distal ends coupled to the deflector.

10. The apparatus of claim 1, wherein the inside surface of the deflector forms an angle of between about 12 and 20 degrees with the centerline of the wobble turbine.

11. The apparatus of claim 1, wherein the housing has an upper portion engaged with a lower portion to allow adjustment of the distance therebetween.

12. The apparatus of claim 11, wherein adjusting the distance between upper and lower portions changes the angle at which the turbine surface contacts the track.

13. The apparatus of claim 11, wherein adjusting the distance provides a variable spray width.

14. The apparatus of claim 1, wherein a flow control valve is disposed in the fluid inlet to provide variable fluid impact control.

15. The apparatus of claim 14, wherein the flow control valve is an insertion member.

16. The apparatus of claim 14, further comprising a flow control device is upstream of the flow valve.

17. The apparatus of claim 16, characterized in that restricting the flow control valve increases the impact of fluid.

18. The apparatus of claim 17, characterized in that the flow control device maintains a substantially constant fluid flow rate through the fluid inlet.

19. The apparatus of claim 1, wherein the wobble turbine provides aeration of a fluid.

20. The apparatus of claim 1, wherein the wobble turbine has an annular groove to provides aeration of a fluid.

21. The apparatus of claim 1, wherein the wobble turbine has an air supply channel formed therein to provide aeration of a fluid.

22. The apparatus of claim 1, wherein the wobble turbine has an annular groove around the wobble turbine to provide aeration of a fluid.

23. The apparatus of claim 1, wherein the wobble turbine is held by the body in an axially spaced relationship to the fluid inlet.

24. A fluid discharging apparatus comprising:

a body having a fluid inlet and a fluid outlet, a track formed adjacent the fluid inlet, and a bearing adjacent the fluid outlet;

a wobble turbine having a first end disposed within the bearing, a second end in rolling contact with the track and facing the fluid inlet for direct contact with fluid flowing therethrough, and a plurality of fluid channels formed between the first and second ends configured to cause the wobble turbine to rotate when a stream of the fluid from the inlet contacts the turbine second end facing the inlet.

25. The apparatus of claim 24, wherein the second end of the wobble turbine is a conical surface.

26. The apparatus of claim 24, wherein the bearing is a sleeve.

27. The apparatus of claim 24, wherein the fluid channels are formed around the perimeter of the turbine.

28. The apparatus of claim 27, wherein the outlet channels are aligned to receive fluid from the inlet as the fluid passes over the second end.

29. The apparatus of claim 28, wherein the fluid channels are configured to discharge fluid adjacent the first end.

30. The apparatus of claim 24, wherein the first end of the wobble turbine is a post, the second end of the wobble turbine is conical, and the bearing is a sleeve.

31. The apparatus of claim 24, further comprising a bearing connection between the first and second ends of the wobble turbine.

* * * * *